US011952179B2

(12) United States Patent
Dominion et al.

(10) Patent No.: US 11,952,179 B2
(45) **Date of Patent: *Apr. 9, 2024**

(54) FOOD STORAGE CONTAINER WITH REVERSIBLE LID

(71) Applicant: D6 LLC, Portland, OR (US)

(72) Inventors: Edward C. Dominion, Portland, OR (US); Martin L. Troudt, Portland, OR (US); Ben McGregor, Portland, OR (US)

(73) Assignee: D6 LLC, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/057,170

(22) Filed: Nov. 18, 2022

(65) Prior Publication Data

US 2023/0227214 A1 Jul. 20, 2023

Related U.S. Application Data

(63) Continuation of application No. 17/100,246, filed on Nov. 20, 2020, now Pat. No. 11,623,795.

(51) Int. Cl.

| | |
|---|---|
| ***B65D 43/02*** | (2006.01) |
| ***B65D 51/16*** | (2006.01) |
| ***B65D 51/20*** | (2006.01) |

(52) U.S. Cl.

CPC ..... *B65D 43/0208* (2013.01); *B65D 51/1605* (2013.01); *B65D 51/20* (2013.01); *B65D 2251/0018* (2013.01); *B65D 2251/0093* (2013.01); *B65D 2543/00194* (2013.01); *B65D 2543/005* (2013.01); *B65D 2543/00537* (2013.01)

(58) Field of Classification Search

CPC .. B65D 43/0208; B65D 43/021; B65D 43/02; B65D 51/20; B65D 43/0212; B65D 21/0219

See application file for complete search history.

(56) References Cited

U.S. PATENT DOCUMENTS 3,117,692 A * 1/1964 Carpenter ..... B65D 43/0212 206/508

D625,911 S 10/2010 Lee et al.

(Continued)

FOREIGN PATENT DOCUMENTS

DE 10218395 A1 11/2003
WO 2006091655 A1 8/2006

OTHER PUBLICATIONS

International Search Report and Written Opinion issued for International PCT Application No. PCT/US2021/072479, dated Mar. 23, 2022, 20 pages.

*Primary Examiner* — Jeffrey R Allen
(74) *Attorney, Agent, or Firm* — Stoel Rives LLP

(57) ABSTRACT

Containers for storing food in a storage compartment may include a base portion of the container. The storage compartment is sealed with a film to get the food stored in the storage compartment fresh. The container further includes a reversible lid that is able to attach to the base portion of the container in two different configurations. In a first configuration the reversible lid attaches to the base portion without affecting the seal created by the film. In a second configuration the reversible lid attaches to the base portion when the lid is inverted and the film is removed from the base portion.

22 Claims, 8 Drawing Sheets

(56) References Cited

U.S. PATENT DOCUMENTS

| | | | | |
|---|---|---|---|---|
| 2004/0134911 | A1 | 7/2004 | Padovani | |
| 2006/0261065 | A1 | 11/2006 | Claypool et al. | |
| 2007/0262077 | A1* | 11/2007 | Stevens | B65D 51/20 220/212 |
| 2013/0140311 | A1 | 6/2013 | Roy et al. | |
| 2016/0152387 | A1 | 6/2016 | Loaiza Alvarez et al. | |
| 2017/0021966 | A1 | 1/2017 | Parikh et al. | |
| 2019/0291927 | A1* | 9/2019 | Farach | B65D 43/0254 |

* cited by examiner

FOOD STORAGE CONTAINER WITH REVERSIBLE LID

CROSS-REFERENCE TO RELATED APPLICATION

This application is a continuation of U.S. patent application Ser. No. 17/100,246, filed Nov. 20, 2020, which is hereby incorporated by reference in its entirety.

TECHNICAL FIELD

The present disclosure relates generally to the field of containers. More particularly, some embodiments relate to food storage containers for storing and transporting food.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

The components of the embodiments as generally described and illustrated in the figures herein can be arranged and designed in a wide variety of different configurations. Thus, the following more detailed description of various embodiments, as represented in the figures, is not intended to limit the scope of the present disclosure, but is merely representative of various embodiments. While various aspects of the embodiments are presented in drawings, the drawings are not necessarily drawn to scale unless specifically indicated.

The phrase "coupled to" is broad enough to refer to any suitable coupling or other form of interaction between two or more entities, including mechanical interactions. Thus, two components may be coupled to each other even though they are not in direct contact with each other. The phrases "attached to" or "attached directly to" refer to interaction between two or more entities that are in direct contact with each other and/or are separated from each other only by a fastener of any suitable variety (e.g., mounting hardware or an adhesive).

Food storage containers may be used for packaging food within the container and then be used to transport the food to a desired location. The food within the storage container may be sealed to help ensure freshness before the food is consumed by a user.

Storage containers typically include a base portion and a lid. The lid is configured to couple to or attach to the base portion. When the lid is attached to the base portion, an airtight seal may be created between the lid and the base portion. When the user opens the lid from the base portion, the airtight seal is broken and the user may consume the contents of the container. In some circumstances, the container may also be used to store any leftover food. The lid may be reattached to the base portion to create an airtight seal to prevent additional air from entering the container after the lid is reattached.

However, air is already within the container with the leftover food. The presence of air in the container leads to air-related oxidation of the food, which causes the food in the container to spoil faster. Accordingly, variable volume containers are containers that can vary the volume inside the container. Accordingly, when the user decides to reattach the lid, the user may decide how much volume is necessary to store the food and may vary the volume of space in the container to help decrease the amount of air contained inside the container to reduce air-related oxidation.

Figure 1:
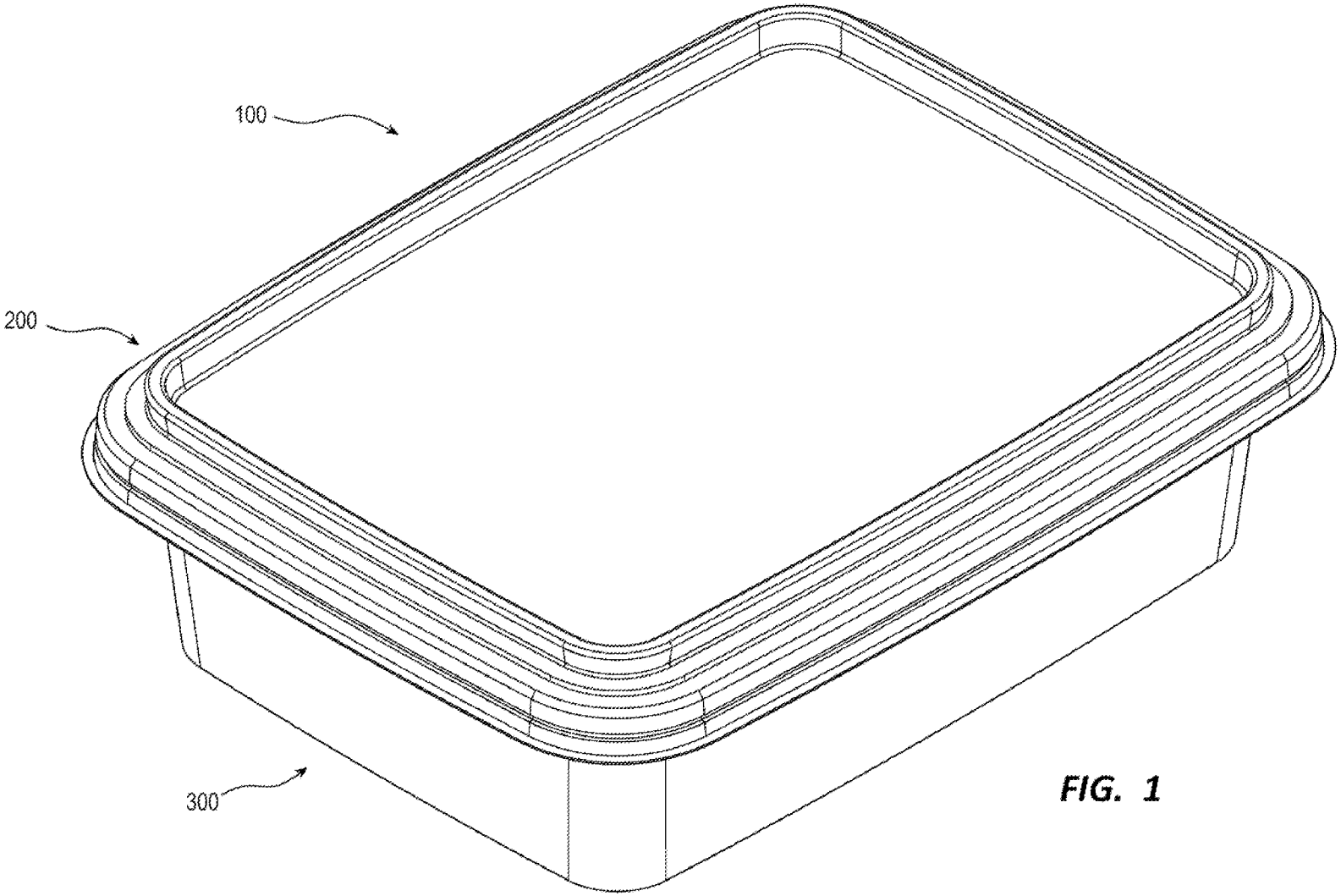
FIG. 1 is a perspective view of a container according to one embodiment of the present disclosure.

FIG. 1 illustrates a perspective view of a food container 100 that comprises a lid 200 attached to a base portion 300. The lid 200 is removably attachable to the base portion 300. In other words, the lid 200 may be attached to the base portion 300, removed from the base portion 300, and then reattached to the base portion 300. As discussed below, the lid 200 may be attached to the base portion 300 in a number of different ways. For example, the lid 200 may be attached to the base portion 300 in a first configuration and the lid 200 may be attached to the base portion 300 in a second configuration in which the lid is inverted or flipped in comparison to the first configuration. In other words, the lid 200 may be a reversible lid in that the user may invert or reverse an orientation of the lid 200 to attach the lid 200 to the base portion 300 in two different configurations. For example, the orientation of the lid 200 in the second configuration is inverted from the orientation of the lid 200 in the first configuration.

Figure 2B:
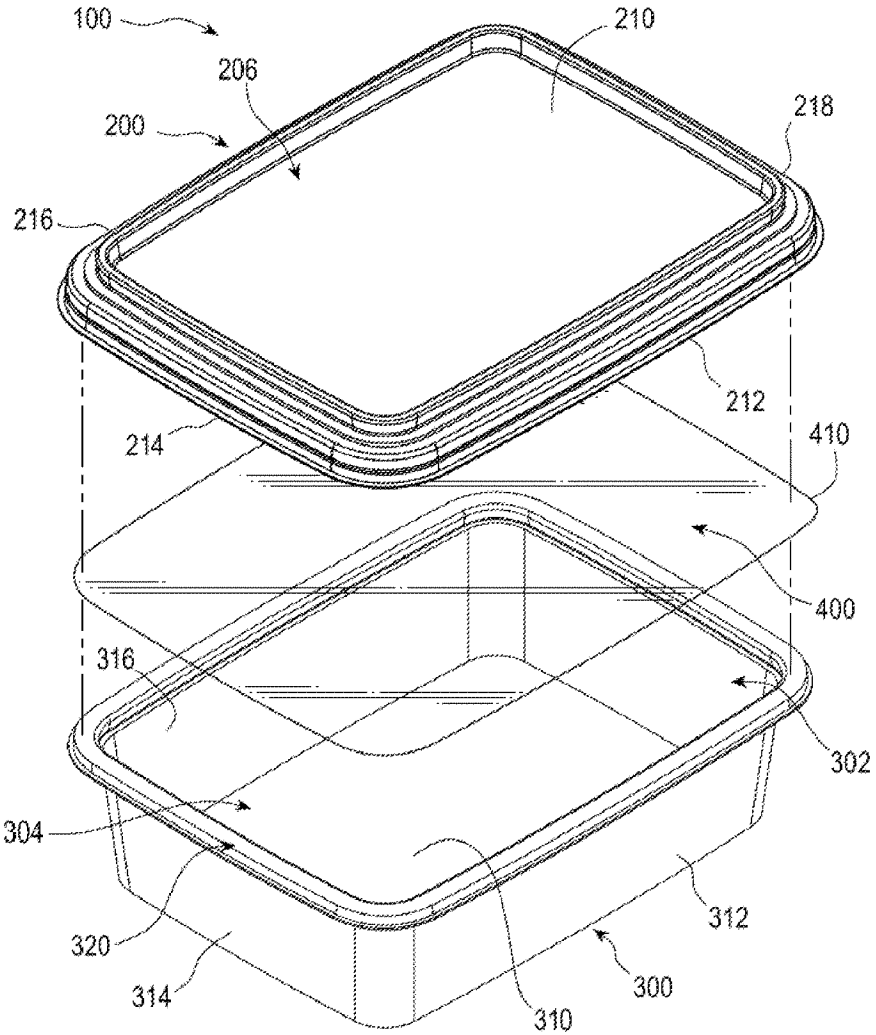
FIG. 2B is an exploded perspective view of the container of FIG. 1 with the lid and the film removed from the base portion of the container.
Figure 2A:
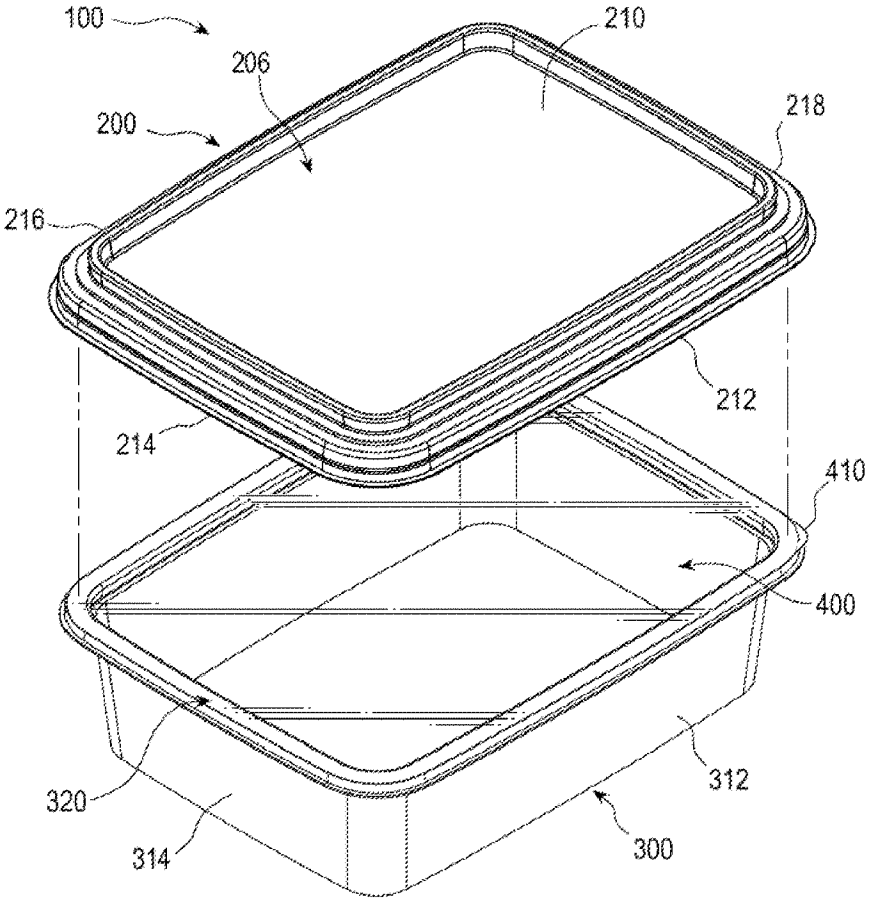
FIG. 2A is a partially exploded perspective view of the container of FIG. 1 with a lid removed from a base portion of the container and a film sealed onto the base portion of the container.

FIG. 1 illustrates the container 100 in the first configuration with the lid 200 attached to the base portion 300. FIG. 2A illustrates the container 100 with the lid 200 detached or removed from the base portion 300 and a film 400 sealed to the base portion 300. FIG. 2B illustrates the container 100 with the lid 200 detached or removed from the base portion 300 and the film 400 removed from the base portion 300.

In the illustrated embodiment, the lid 200 has a rectangular shape and the base portion 300 has a corresponding cuboid shape with four sidewalls. However, the present disclosure is not so limited. The lid 200 may have a circular, polygonal, triangular, oval, and the like shape. The base portion 300 may have a shape that corresponds with the shape of the lid 200. For example, the base portion 300 may comprise a cubic shape, a cylindrical shape, a prism shape, and the like. If the base portion has a cylindrical shape, the base portion may only have one sidewall.

The base portion 300 comprises a base panel 310 lying in a plane. In the illustrated embodiment of a cuboid container, the base panel 310 comprises a rectangular shape. The base portion 300 further comprises a first sidewall 312, a second sidewall 314, a third sidewall 316, and a fourth sidewall 318, each sidewall comprising a substantially rectangular shape. The sidewalls 312, 314, 316, and 318 each extend upward from a perimeter of the base panel 310. In the illustrated embodiment, the sidewalls 312, 314, 316, and 318 may be slightly angled outward with an opening 302 disposed at the top of the base portion 300. In some embodiments, the sidewalls 312, 314, 316, and 318 may extend straight upward at a 90° angle.

The first sidewall 312 is opposite the third sidewall 316 and the second sidewall 314 is opposite the fourth sidewall 318. The first sidewall 312 and the third sidewall 316 may be similarly shaped and be the same length, and the second sidewall 314 and the fourth sidewall 318 may be similarly shaped and be the same length.

The sidewalls 312, 314, 316, and 318 define corners of the base portion 300. In the illustrated embodiment, the corners are rounded, with relatively large radiuses; however, in other embodiments the corners may be sharper, with much smaller radiuses.

The base portion 300 comprises a storage compartment 304 that is configured to store food or other items. The storage compartment 304 may comprise a plurality of compartments that may be used to store a variety of different foods or other items in the container 100. For example, the storage compartment may comprise a plurality of compartment walls that define the plurality of storage compartments.

The container 100 may be fabricated from a number of different materials. For example, the lid 200 and the base portion 300 of the container may be fabricated from polyethylene terephthalate (PET), polyethylene terephthalate glycol (PETG), Polylactic acid (PLA), Polypropylene (PP), or any other suitable material that may be used for food containers. The lid 200 and the base portion 300 may be transparent or opaque.

Food may be placed in the storage compartment 304 through the opening 302. Once the food is placed in the storage compartment 304, the food may be sealed within the base portion 300. A film 400 may be placed over the opening 302 of the base portion 300 at an upper rim 320 then coupled to or attached to the upper rim 320. The film 400 may be a different material than the lid 200 and the base portion 300. The film 400 may be a highly flexible material and may be thin (e.g., between 0.0015 and 0.005 inches). The film 400 may have a low permeability to oxygen. Example materials for the film 400 may include polyethylene, polypropylene, and the like. The film 400 may have a lower melting point that the material for the base portion 300. The film 400 may be sealed to the upper rim 320 using a number of different techniques, such as an adhesive, heat sealing, ultrasonic sealing, RF welding, and the like.

The film 400 is configured to seal the food within the storage compartment 304 of the base portion 300. The sealing of the food within the storage compartment 304 helps preserve the freshness of food in the container 100 during transport and when container 100 is on display. The headspace inside the storage compartment 304 may be filled with a neutral gas, such as nitrogen, to reduce oxygen and increase shelf life, thereby helping reduce the rate of spoilage. The film 400 may also provide a highly reliable tamper-evident feature.

After the food is placed in the storage compartment 304 and the food is sealed within the storage compartment 304 by the film 400, the lid 200 may be attached to the base portion 300. In some embodiments, the attachment of the lid 200 to the base portion 300 may create a leak resistant seal separate from the seal 400 created by the film 400. In some embodiments, the attachment of the lid 200 to the base portion 300 may create a ventable seal in which air may be able to enter and exit the space above the film 400. For example, the container 100 may be able to vent or allow air to enter the container 100 due to pressure differences between the outside environment and interior of the container 100. The ventable seal may also allow any gases produced in the container to be vented out as well.

Figure 3:
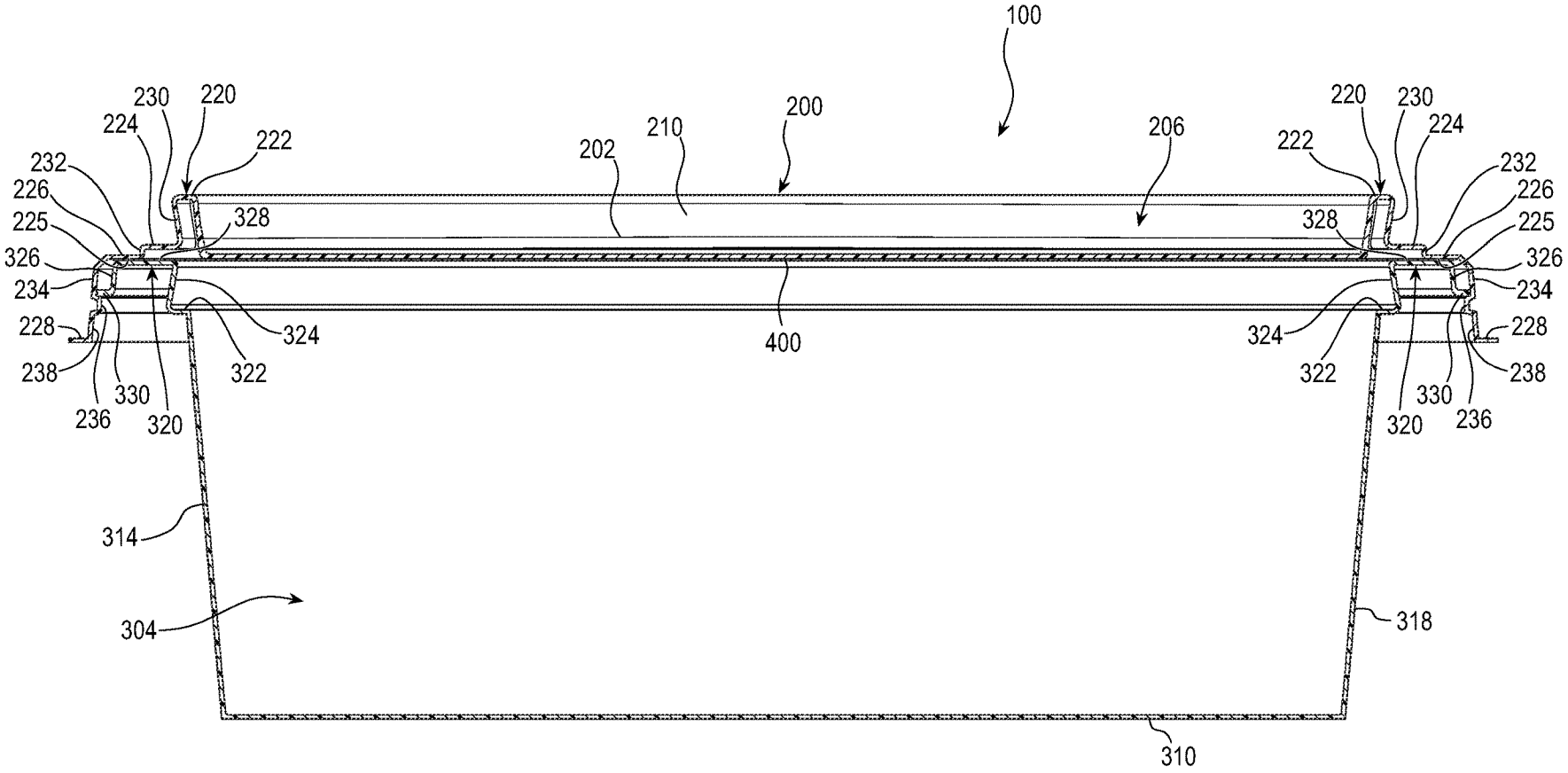
FIG. 3 is a cross-sectional view of the container of FIG. 1.

FIG. 3 illustrates a cross-sectional view of the container 100 in the first configuration with the lid 200 attached to the base portion 300. The base portion 300 further comprises an internal shoulder 322 that extends along the entire perimeter of the base portion 300. In other words, the internal shoulder 322 is disposed on each sidewall 312, 314, 316, and 318 and curves around the corners where the sidewalls 312, 314, 316, and 318 meet. The internal shoulder 322 is disposed below the upper rim 320 of the base portion 300. The internal shoulder 322 is disposed inward of the upper rim 320 such that the innermost portion of the internal shoulder 322 is more inward than the innermost portion of the upper rim 320. The outermost portion of the internal shoulder 322 may be more outward than the innermost portion of the upper rim 320.

The upper rim 320 may comprise an inner wall 324 and an outer wall 326. In other words, the upper rim 320 is disposed on each sidewall 312, 314, 316, and 318 and curves around the corners where the sidewalls 312, 314, 316, and 318 meet. The inner wall 324 extends upward from the internal shoulder 322 to an upper surface 328 of the upper rim 320. The upper surface 328 may have a predetermined width. In the illustrated embodiment, the inner wall 324 extends upward and inward at an acute angle relative to internal shoulder 322, such that the inner wall 324 is undercut and overhanging a portion of internal shoulder 322. The angle between the internal shoulder 322 and the inner wall 324 may be between 74 and 80 degrees. The outer wall 326 extends downward toward a lip 330. The outer wall 326 may extend away from the upper rim 320 between 0.05 and 0.2 inches. The lip 330 extend away from the outer wall 326 between 0.04 and 0.1 inches. The outer wall 326 may extend outward and downward at an angle. The lip 330 extends along the entire perimeter of the upper rim 320.

The lid 200 includes a central panel 210 lying in a plane. In the cuboid container embodiment illustrated, the panel 210 has a substantially rectangular shape, but in other embodiments shape may be different, so as to correspond to the overall shape of the container. The lid 200 further comprises a first edge 212, a second edge 214, a third edge 216, and a fourth edge 218. The edges 212, 214, 216, and 218 form a perimeter of the lid 200.

The lid 200 comprises a rim 220. The rim 220 extends in a first direction away from the panel 210. In the first configuration, illustrated in FIGS. 1-3, the rim 220 extends upward and outward from the panel 210. When the lid is inverted in the second configuration, illustrated in FIGS. 6 and 7, the rim 220 extends downward and outward from the panel 210. The rim 220 may extend upward and outward at an obtuse angle relative to panel 210. The angle between the rim 220 and the panel 210 may be between 100 and 106 degrees.

The rim 220 comprises a surface 222 with a predetermined width in a plane and has a substantially rectangular shape. The plane of the surface 222 is parallel with the plane of the panel 210. In some embodiments, the surface 222 may be curved instead of flat.

The rim 220 defines and bounds a recess 206 adjacent to panel 210. The recess 206 is sized to receive a bottom portion of the base portion 300 to facilitate stable stacking of multiple containers, with the rim 220 providing lateral support to prevent stacked containers from sliding.

The lid 200 comprises a first shoulder 224 that is disposed outside the rim 220 but within the perimeter of the lid 200. The first shoulder 224 extends outward in a plane away from the rim 220 and toward the perimeter, and lies in a plane that may be parallel to, but different from, the plane of the surface 222 of the rim 220, and may be parallel to the plane of the panel 210. In some embodiments, the first shoulder 224 may be curved instead of flat. In some embodiments, the first shoulder 224 may be disposed in the same plane as the panel 210. In some embodiment, the lid 200 does not include the first shoulder.

The lid 200 may further comprise a second shoulder 226 that is disposed outside the first shoulder 224 but within the perimeter of the lid 200. The second shoulder 226 extends outward in a plane away from the rim 220 and toward the perimeter, but in a different plane than but parallel to the plane of the surface 222 of the rim 220. In the illustrated embodiment, the plane of the second shoulder 226 is in the same plane as the panel 210. In some embodiments, the plane of the second shoulder 226 is in a different plane than but parallel to the plane as the panel 210. In some embodiments, the second shoulder 226 may be curved instead of flat.

The lid 200 may further comprise a third shoulder 228 that is disposed outside the second shoulder 226. An outer edge of the third shoulder 228 corresponds with the perimeter of the lid 200. The third shoulder 228 extends outward in a plane away from the rim 220, but in a different plane but parallel to the plane of the surface 222 of the rim 220, the first shoulder 224, and the second shoulder 226. In some embodiments, the third shoulder 228 may be curved instead of flat.

Each of the shoulders 224, 226, and 228 are formed on each side of the lid 200. In other words, each shoulder 224, 226, and 228 extends along each side of the lid 200 curves at each corner of the lid 200 to form a continuous shoulder.

The lid 200 may comprise a first wall 230 that connects the surface 222 to the first shoulder 224. In some embodiments, the first wall 230 may have a slight angle outward. The angle between the first wall 230 and the first shoulder 224 may be an acute angle. The angle between the first wall 230 and the first shoulder 224 may be between 74 and 80 degrees.

The lid 200 may comprise a second wall 232 that connects the first shoulder 224 to the second shoulder 226. In some embodiments, the second wall 232 may be substantially vertical. The lid 200 may comprise a third wall 234 that connects the second shoulder 226 to the third shoulder 228. In some embodiments, the third wall 234 may have a slight angle outward. Each of the walls 230, 232, and 234 is formed on each side of the lid 200. In other words, each wall 230, 232, and 234 extends along each side of the lid 200 curves at each corner of the lid 200 to form a wall.

In the first configuration, illustrated in FIGS. 1-3, the surface 222 of the rim 220 is the highest point of the lid 200, followed by the first shoulder 224, the second shoulder 226, and the third shoulder 228. As discussed, the surface 222, the first shoulder 224, the second shoulder 226, and the third shoulder 228 may all be on different planes. A height of the third wall 234 may be greater than the heights of the second wall 232 and the first wall 230. The height of the first wall 230 may be greater than the height of the second wall 232 but less than the height of the third wall 234. The height of the second wall 232 may be less than the heights of the first wall 230 and the third wall 234. In some embodiments, the height of the third wall 234 may be big enough to give the user a good grip to remove the lid 200 from the base portion 300 when the lid 200 is attached to the base portion 300 in the second configuration.

The lid 200 may further comprise a rib 236 disposed on an inner surface 238 of the third wall 234. The rib 236 is disposed between the second shoulder 226 and the third shoulder 228. The rib 236 may project inward from the inner surface 238 of the third wall 234 and may extend along each side of the lid 200 and curve at each corner of the lid 200.

The rib 236 is configured to engage with the lip 330 of the base portion 300 of the container 100. When the lid 200 is placed on the base portion 300 of the container 100 with a predetermined amount of force, the rib 236 snaps over the lip 330 and secures the lid 200 to the base portion 300. Similarly, if the lid 200 is pulled upward with a predetermined amount of the force, the rib 236 snaps over the lip 330 and detaches the lid 200 from the base portion 300 of the container 100. Accordingly, the lid 200 attaches to the base portion 300 in the first configuration by snap fit.

Figure 5:
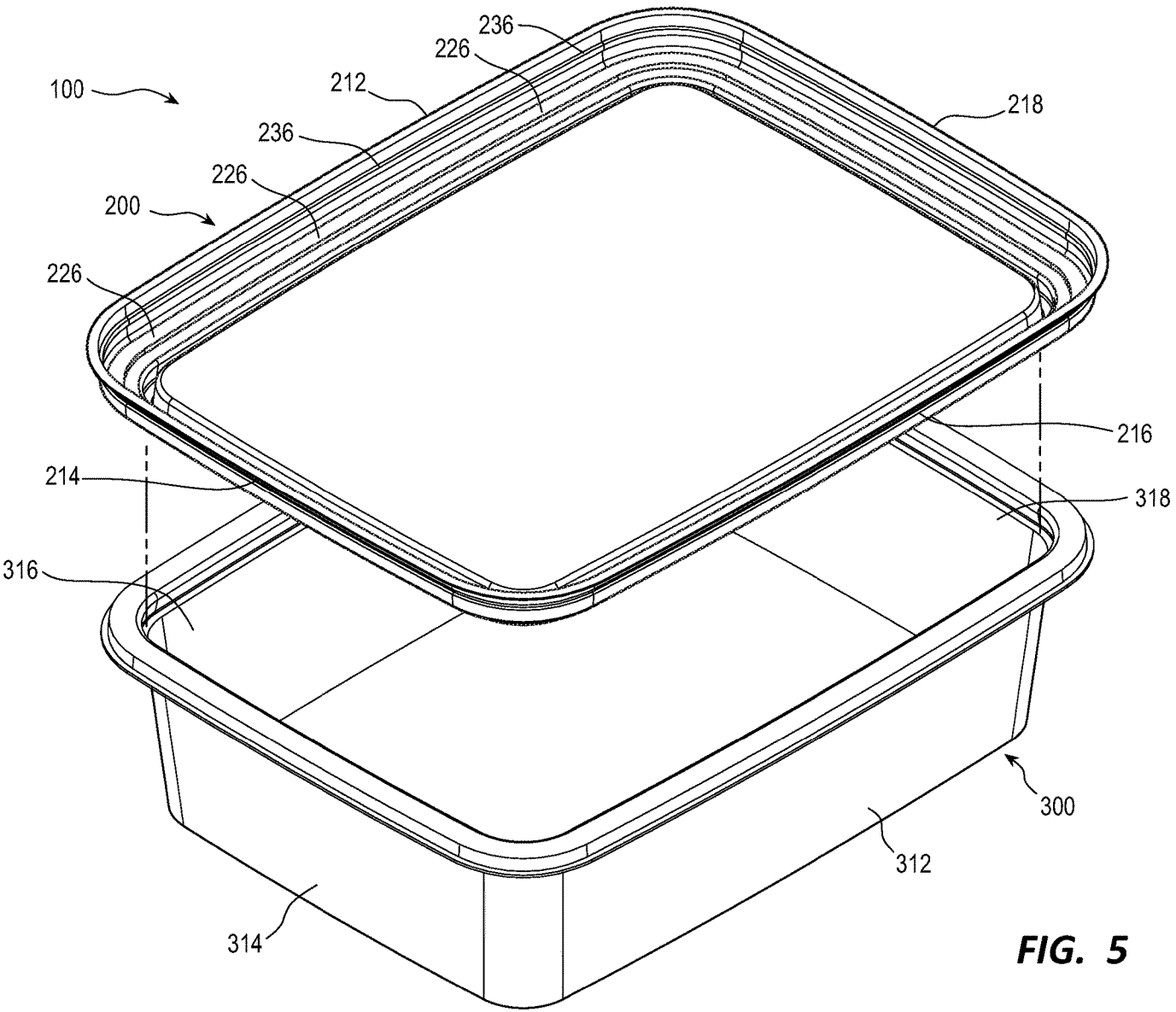
FIG. 5 is a perspective view of the container of FIG. 1 with the lid in an inverted configuration and the base portion.
Figure 6:
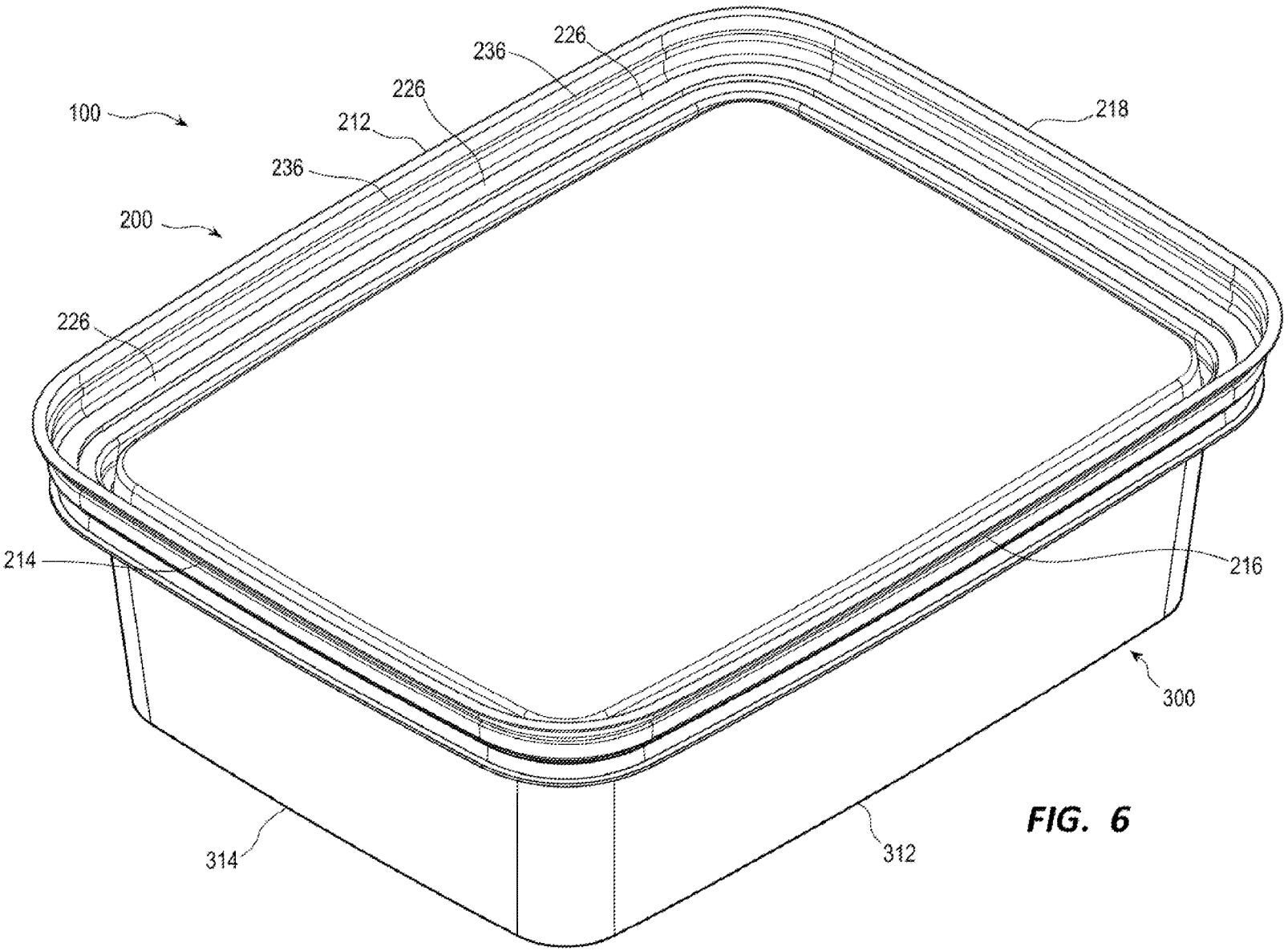
FIG. 6 is a perspective view of the container of FIG. 1 with the lid in an inverted configuration attached to the base portion.

When the lid 200 is attached to the base portion 300 in the first configuration, an inside surface 225 of the second shoulder 226 is pressed against the rim 220 of the base portion 300. In some embodiments, this creates a leak-resistant seal. In some embodiments, this creates a ventable seal in which air may be able to enter and exit the space above the film 400 due to the fact the second shoulder 226 may comprise some breaks, as illustrated in FIGS. 5 and 6. As illustrated in FIG. 3, when the lid 200 is attached to the base portion 300, the panel 210 presses against the film 400 without damaging the seal created by the film 400 and the upper rim 320 of the base portion 300. One of the benefits of this configuration is when the containers 100 are stacked, the weight of the container 100 on top may be distributed on the lid 200 and the film 400.

When a user wishes to gain access to the food sealed within the container 100, the user may remove the lid 200 and peel the film 400 from the upper rim 320 of the base portion 300. The film 400 may comprise a peeling tab 410 that overlaps the upper rim 320 in one of the corners of the base portion 300. In the illustrated embodiment, the film 400 only comprises a single peeling tab 410. However, the film 400 may comprise a plurality of peeling tabs disposed in each corner of the film 400.

Figure 4:
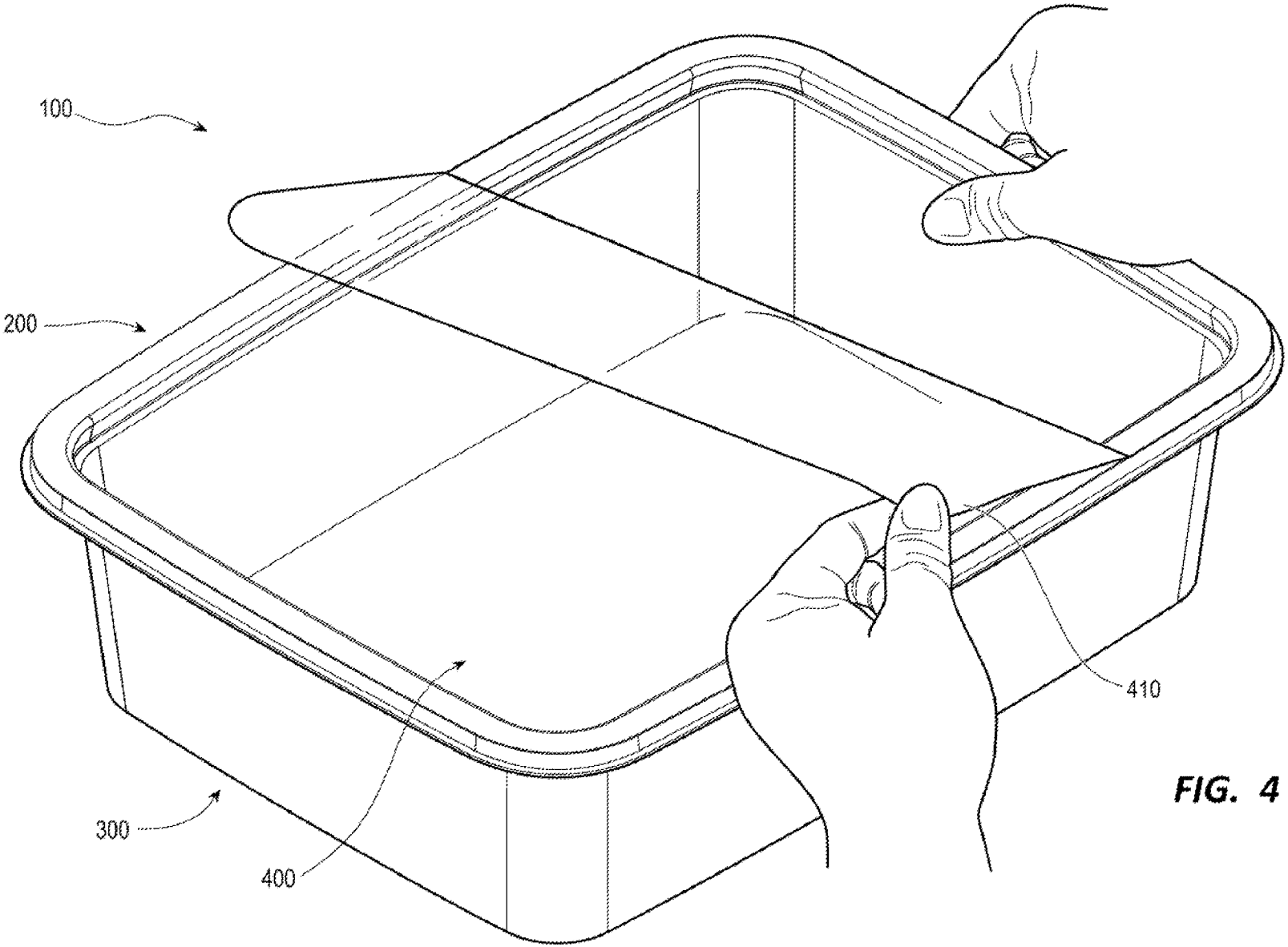
FIG. 4 is a perspective view of the base portion of FIG. 1 with a film sealed onto the base portion of a container being peeled off the base portion.

A user may grip the peeling tab 410 and pull on the peeling tab 410 to peel the film 400 from the upper rim 320 of the base portion 300, as shown in FIG. 4. After the film 400 is peeled off the upper rim 320 of the base portion 300, the user may eat the food stored in the storage compartment 304 of the base portion 300. However, the user does not need to completely remove the film 400 from the upper rim 320 of the base portion 300; the user may only partially peel the film 400 from the upper rim 320 to gain access to the storage compartment 304.

After the user has removed the lid 200 from the base portion 300 and removed the film 400 to gain access to the food, the user may reattach the lid 200 to the base portion 300. This may be useful to store leftover food if not all of the food in the storage compartment 304 was consumed. This way the user may store the food in the container 100 for future consumption. The lid 200 may be placed on the base portion 300 in the first configuration, or the lid 200 may be inverted and placed on the base portion 300 in the second configuration. In some embodiments, the inversion of the lid 200 may reduce the volume of air in the storage compartment 304 when the lid 200 is attached to the base portion 300 in the second configuration in comparison to the attachment of the lid 200 to the base portion 300 in the first configuration.

FIG. 5 illustrates a perspective view of the container 100 with the lid 200 detached from the base portion 300 but with the lid 200 inverted. FIG. 6 illustrates a perspective view of the container 100 with the lid 200 reattached to the base portion 300 in the second configuration.

As shown in the illustrated embodiment, the rib 236 may actually be a plurality of ribs. For example, some of the ribs 236 may round the corner, whereas some of the other ribs 236 are straight and extend in the same direction as one of the edges 212, 214, 216, and 218. In some embodiments, the rib 236 may extends along the entirety of the inner wall 238 of the lid 200.

The lid 200 in the inverted position is configured to attached to the base portion 300 and provide a more secure seal between the lid 200 and the base portion 300 in comparison to the first configuration. The storage compartment 304 may be sealed by the film 400 before the film 400 has been peeled off. In addition, in the first configuration, the inside surface 225 of the second shoulder 226 is configured to press against the upper rim 320 of the base portion 300, which may help secure the film 400 in place.

Figure 7:
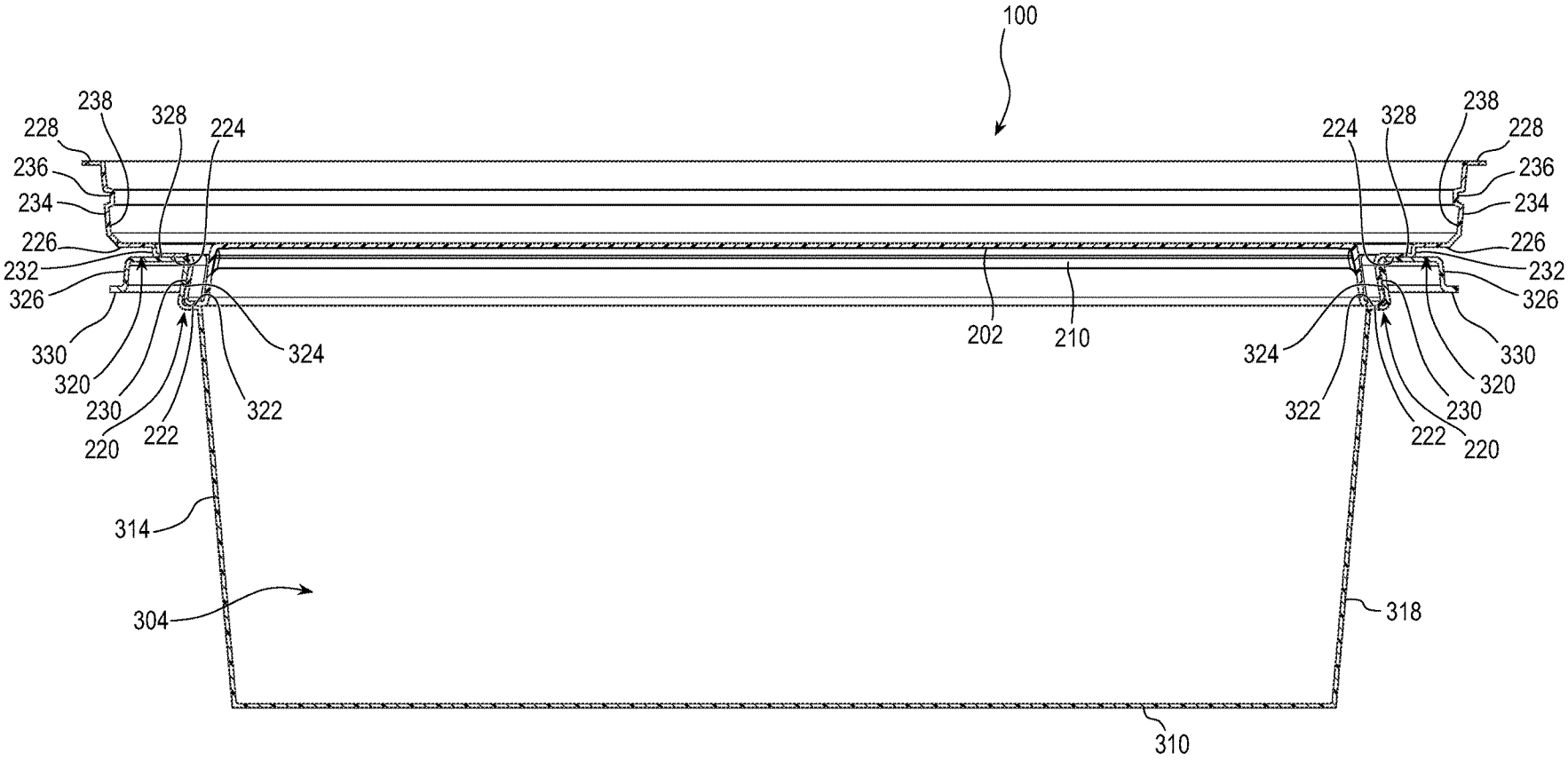
FIG. 7 is a cross-sectional view of the container of FIG. 6.

In the second configuration, with the lid 200 inverted, the lid 200 engages with multiple surfaces of the base portion 300 of the container 100. FIG. 7 illustrates a cross-sectional view of the container 100 in the second configuration. In the second configuration, the surface 222 of the rim 220 is pressed against the internal shoulder 322 of the base portion 300, the first wall 230 is pressed against the inner wall 324 of the upper rim 320, and the first shoulder 224 is pressed against the upper rim 320 of the base portion 300. The combination of the three different surfaces of the lid 200 pressing against the three different surfaces of the base portion 300 creates a leak resistant seal.

The inverted lid 200 attaches to the base portion 300 by the interaction of the upper rim 320 of the base portion 300 and the rim 220 of the lid 200. In the inverted configuration, the rim 220 of the lid 200 extends downward and outward from the panel 210. The inner wall 324 may extend upward and inward from the internal shoulder 322. The rim 220 of the lid 200, the inner wall 324, and the internal shoulder 322 may have corresponding shapes such that the rim 220 is configured to snap into place against the inner wall 324 and the internal shoulder 322 of the base portion 300 with a predetermined amount of force. Accordingly, the lid 200 attaches to the base portion 300 in the second configuration by snap fit.

The lid 200 and the base portion 300 may be manufactured using a number of different methods. For example, each of the lid 200 and the base portion 300 may be formed via a thermoforming manufacturing process in which a plastic sheet of material is heated to a pliable forming temperature and formed to a specific shape in a mold and trimmed to create the lid 200 and the base portion 300. After the lid 200 and the base portion 300 are fabricated, a plurality of lids 200 may be stacked together and a plurality of base portions 300 may be stacked together.

In stacking the base portions 300, the design on the base portions 300 prevents one base portion 300 from nesting completely within another base portion 300. An underside of the internal shoulder 322 of the base portion is configured to be placed on the upper rim 320 due to the undercut of the inner wall 324. Thus, when the base portion 300 are stacked together, they are easily separated due to the fact they there is a vertical distance between stacked lips 330 of adjacent base portions 300.

The plurality of stacked lids 200 and the plurality of stacked base portions 300 may be transported to food preparation facilities where food may be prepared and placed into the storage compartment 304 of the base portion 300. The food may then be sealed with the film 400 along the upper rim 320 of the base portion 300. After the food is sealed, the lid 200 may be placed on the base portion 300 in the first configuration. As described above, the lid 200 is not configured to attach to the base portion 300 in the second configuration when the film 400 is sealed to the upper rim 320 of the base portion 300 because the rim 220 of the lid 200 is configured to be inserted past the upper rim 320 of the base portion 300.

After the lid 200 is attached to the base portion 300, a plurality of containers 100 may be stacked upon each other to transport the containers 100 that have food packaged in the containers 100.

Figure 8:
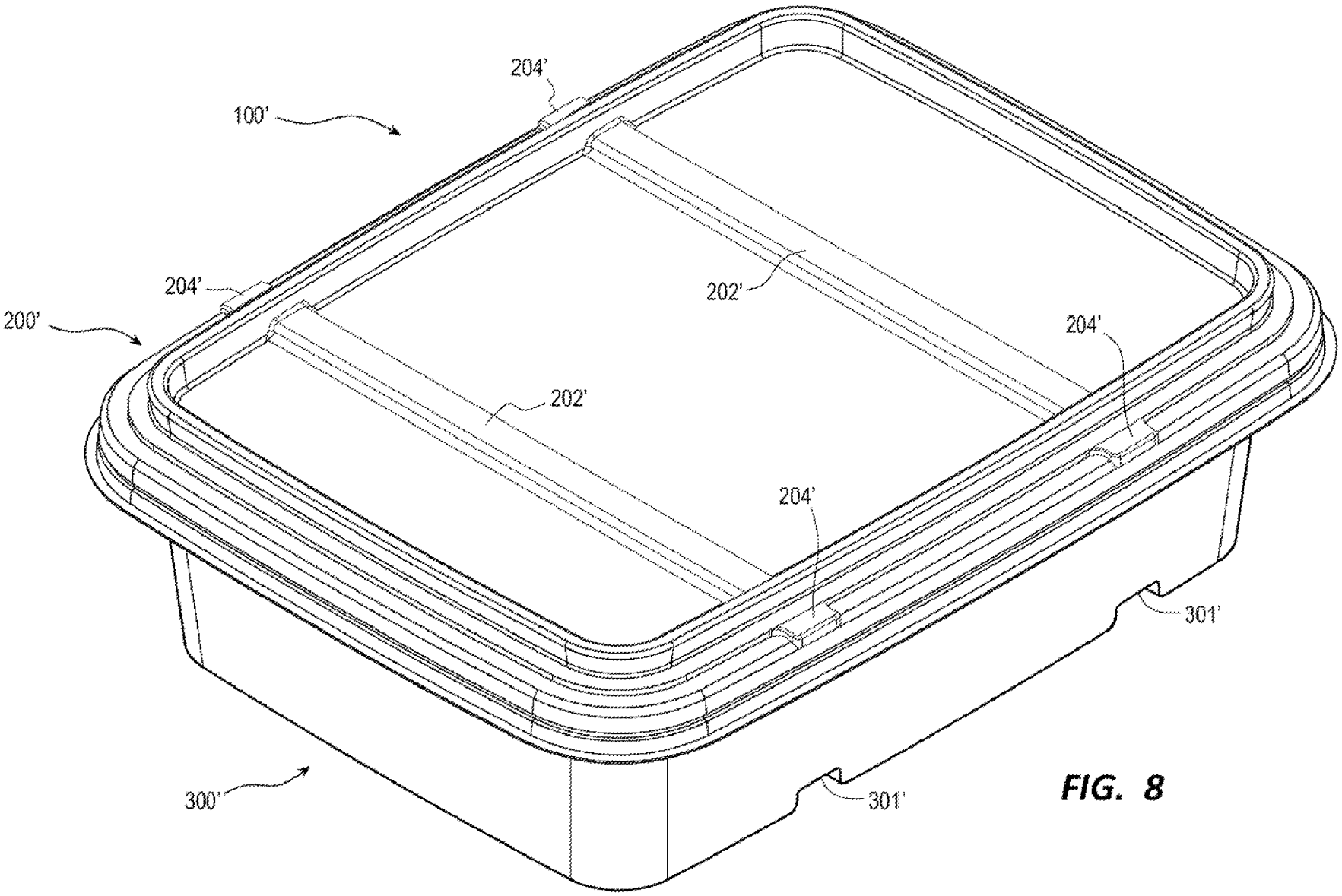
FIG. 8 is a perspective view of a container according to one embodiment of the present disclosure.

FIG. 8 depicts an embodiment of a container 100' that resembles the container 100 described above in certain respects. Accordingly, like features are designated with like reference numerals, with an added apostrophe. For example, the embodiment depicted in FIG. 8 includes a lid 200' and a base portion 300' that may, in some respects, resemble the lid 200 and the base portion 300 of FIGS. 1-7. Relevant disclosure set forth above regarding similarly identified features thus may not be repeated hereafter. Moreover, specific features of container 100 and related components shown in FIG. 1-7 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the container 100' and related components depicted in FIG. 8. Any suitable combination of the features, and variations of the same, described with respect to the container 100 and related components illustrated in FIGS. 1-7 can be employed with the container 100' and related components of FIG. 8, and vice versa.

FIG. 8 depicts the container 100' that includes the lid 200' and the base portion 300'. The lid 200' may comprise a plurality of lateral extending ribs 202' and feet 204'. The lateral extending ribs 202' may extend upward from a panel 210' of the lid 200'. The feet 204' may extend laterally away from a second wall 232' of the lid 200', and a top surface of the ribs 202' may be disposed in the same plane as a first shoulder 224'. The feet 204' may provide an aperture to allow air to flow into and out of the container 100, especially when a film is attached to the base portion 300'.

The ribs 202' and the feet 204' may provide additional structural stability in the stacking process of multiple containers 100'. The base portion 300' may include laterally extending ribs 301' that are configured to nest with the laterally extending ribs 202' of the lid 200'.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. It will be apparent to those having skill in the art that changes may be made to the details of the above-described embodiments without departing from the underlying principles of the present disclosure.

What is claimed is:

1. A container comprising:

a base portion having a base panel and at least one sidewall extending generally upward from a perimeter of the base panel to define a storage compartment, the at least one sidewall forming an upper rim defining an opening into the storage compartment;

a film removably attached to the upper rim of the base portion to cover the opening and seal the storage compartment;

a reversible lid that is configured to detachably couple to the base portion in a first configuration when the film is coupled to the upper rim and in a second configuration when the film is removed from the upper rim, wherein an orientation of the lid in the second configuration is inverted from an orientation of the lid in the first configuration, the lid including:

a panel disposed in a first plane, a rim surrounding the panel, the rim extending away from the first plane, a shoulder disposed in the first plane and extending outwardly from the rim, the shoulder facing the upper rim of the base portion when the lid is attached to the base portion in the first configuration, and a first shoulder disposed between the rim and the shoulder in a second plane that is different from the first plane so as to leave a gap between the first shoulder and the upper rim of the base portion when the lid is attached to the base portion in the first configuration.

2. The container of claim 1, wherein the lid is also attachable to the base portion in the first configuration when the film is removed from the upper rim or when the film is partially removed from the upper rim.

3. The container of claim 1, wherein the lid is configured to attach to the base portion in the first configuration and in the second configuration by snap fit.

4. The container of claim 1, wherein the lid creates a ventable seal along the upper rim when the lid is attached to the base portion in the first configuration.

5. The container of claim 1, wherein, when attached to the base portion in the second configuration, the lid presses against three separate surfaces of the base portion to create a leak-resistant seal.

6. The container of claim 1, wherein the base portion comprises four sidewalls that define a storage compartment with a substantially cuboid shape.

7. The container of claim 1, wherein the base portion comprises a single sidewall that defines a storage compartment with a substantially cylindrical shape.

8. The container of claim 1, wherein the base portion of the container comprises an internal shoulder that is disposed beneath the upper rim of the base portion, at least a portion of the internal shoulder disposed on the at least one sidewall, and the internal shoulder extends in a continuous loop along the entire perimeter of the base portion.

9. The container of claim 1, wherein the shoulder presses against the upper rim of the base portion when the lid is attached to the base portion in the first configuration, and the first shoulder presses against a portion of the upper rim when the lid is attached to the base portion in the second configuration.

10. The container of claim 8, wherein the base portion includes an inner wall that extends upwardly from the internal shoulder and toward the upper rim of the base portion, the inner wall being undercut so as to overhang a portion of the internal shoulder.

11. The container of claim 10, wherein when the lid is attached to the base portion in the second configuration, a first wall of the rim of the lid presses against the inner wall to draw the rim against the inner shoulder of the base portion.

12. A container for storing food, comprising:

a base portion defining a storage compartment to store food, the base portion having an upper rim surrounding an opening into the storage compartment;

a film removably attached to the upper rim of the base portion to cover the opening and seal the storage compartment, wherein the film is removable from the base portion to gain access to the food in the storage compartment; and a reversible lid including:

a central panel disposed in a first plane, a rim surrounding the panel, the rim extending away from the first plane, a shoulder extending outwardly from the rim, and a first shoulder disposed between the rim and the shoulder in a second plane that is different from the first plane, the lid attachable to the base portion in two different configurations, including a first configuration in which the panel of the lid presses against the film without damaging the seal created by the film and the shoulder faces the upper rim of the base portion, and a second configuration in which the lid is inverted relative to the first configuration and snap-fit to the base portion to form a leak-resistant seal after the film is removed from the base portion.

13. The container of claim 12, wherein the shoulder of the lid presses against the upper rim in the first configuration to create an airtight seal between the lid and the base portion.

14. The container of claim 12, wherein, in the second configuration, the lid presses against three separate surfaces of the base portion to create the leak-resistant seal.

15. The container of claim 12, wherein the base portion comprises four sidewalls that define the storage compartment with a substantially cuboid shape.

16. The container of claim 14, wherein the three separate surfaces of the base portion lie in three different planes.

17. The container of claim 12, wherein the base portion of the container comprises an internal shoulder that is disposed beneath the upper rim of the base portion, at least a portion of the internal shoulder disposed on a sidewall of the base portion, and the internal shoulder extends in a continuous loop.

18. The container of claim 17, wherein:

the base portion includes an inner wall that extends upwardly from the internal shoulder and toward the upper rim of the base portion, the inner wall being undercut so as to overhang a portion of the internal shoulder; and when the lid is attached to the base portion in the second configuration, a first wall of the rim of the lid presses against the inner wall and to draw the rim against the inner shoulder of the base portion.

19. The container of claim 1, wherein when the lid is attached to the base portion in the first configuration the panel of the lid presses against the film without damaging the seal created by the film.

20. The container of claim 1, wherein the lid includes a rib disposed between the shoulder and a perimeter edge of the lid, and the rib engages the base portion when the lid is in the first configuration to thereby detachably retain the lid on the base portion.

21. The container of claim 5, wherein the three separate surfaces of the base portion lie in three different planes.

22. The container of claim 12, wherein the first shoulder presses against a portion of the upper rim when the lid is attached to the base portion in the second configuration.

* * * * *